US006539733B2

(12) United States Patent
Sone

(10) Patent No.: US 6,539,733 B2
(45) Date of Patent: Apr. 1, 2003

(54) THERMOSIPHON

(75) Inventor: Kazuya Sone, Niigata-ken (JP)

(73) Assignee: Twinbird Corporation, Niigata-ken (JP)

( * ) Notice: Subject to any disclaimer, the term of this patent is extended or adjusted under 35 U.S.C. 154(b) by 0 days.

(21) Appl. No.: 09/983,475

(22) Filed: Oct. 24, 2001

(65) Prior Publication Data

US 2002/0050146 A1 May 2, 2002

(30) Foreign Application Priority Data

Nov. 1, 2000 (JP) ..... 2000-335093

(51) Int. Cl.[7] ..... F25B 41/00; F25D 15/00
(52) U.S. Cl. ..... 62/119; 62/513; 165/104.11
(58) Field of Search ..... 62/113, 119, 478, 62/498, 527, 513; 165/104.11, 104.21

(56) References Cited

U.S. PATENT DOCUMENTS

| | | | | |
|---|---|---|---|---|
| 2,405,392 A | | 8/1946 | Atchison | |
| 4,382,466 A | * | 5/1983 | Shiraishi | 165/104.11 |
| 4,546,608 A | * | 10/1985 | Shiina et al. | 60/649 |
| 5,142,872 A | | 9/1992 | Tipton | |
| 5,655,598 A | * | 8/1997 | Garriss et al. | 165/104.14 |
| 6,112,526 A | | 9/2000 | Chase | |

FOREIGN PATENT DOCUMENTS

| | | | | |
|---|---|---|---|---|
| DE | 134118 | | 10/1902 | |
| DE | 4312830 | | 10/1994 | |
| EP | 1167900 | | 1/2002 | |
| GB | 2313182 | | 11/1997 | |
| JP | 60-103296 | * | 11/1983 | 165/104.21 |
| JP | 5-106976 | * | 4/1993 | 165/104.21 |

* cited by examiner

*Primary Examiner*—Denise L. Esquivel
*Assistant Examiner*—Melvin Jones
(74) *Attorney, Agent, or Firm*—Greenblum & Bernstein, P.L.C.

(57) ABSTRACT

A thermosiphon is provided of low cost and simple construction and having a condenser which can reliably discharge a condensed working fluid from an outlet pipe even if the apparatus is somewhat inclined. A thermosiphon 1 comprises a condenser 2 connected to a cold part B of a refrigeration apparatus A, and a capillary 3*a* and a large diameter pipe 3*b* connected to the condenser 2 and which can pass a working fluid thereinside. The condenser 2 comprises; an attachment part 4 attached to the cold part B for conducting cold from the cold part B, and a condensing part 5 provided at an end of the attachment part 4 for condensing the working fluid. The condensing part 5 has a cavity portion 6 thereinside, and an inside bottom part 6*a* of the cavity portion 6 is formed descending towards an outlet hole 12 communicating with the capillary 3*a* for the working fluid.

6 Claims, 8 Drawing Sheets

THERMOSIPHON

BACKGROUND OF THE INVENTION

1. Field of Invention

The present invention relates to a thermosiphon, and in particular to a condenser for condensing a working fluid, in a thermosiphon.

2. Description of the Related Art

Heretofore, as a thermosiphon used for example in a refrigeration apparatus, one where a condenser is constructed by coiling a part of a pipe with a working fluid filled thereinside into a coil shape, and this condenser then covered over an outer periphery of the cold part of the refrigeration apparatus, is used. Furthermore, there is also known a thermosiphon of a construction where an inlet pipe and an outlet pipe for a working fluid are connected above and below a condenser constructed with a plurality of holes bored in parallel in a metal block so as to surround a cold part and then a working fluid is filled into the condenser, the inlet pipe and the outlet pipe. Moreover, in this thermosiphon, the holes are communicated with an inside bottom part of the condenser, the construction being such that the working fluid condensed in the holes accumulates at the inside bottom part of the condenser and flows out from an outlet portion to an outlet pipe connected to the bottom side of the condenser.

However, in the former configuration, if the apparatus using this thermosiphon is inclined, the condensed working fluid accumulates inside the condenser, so that there is the likelihood of a drop in the heat transport efficiency. Moreover, in the latter configuration also, if an apparatus using this thermosiphon is inclined, then depending on the incline direction, the position of the liquid portion can become higher than the inside bottom face of the condenser. If so, then as with the former configuration, the condensed working fluid accumulates inside the condenser so that there is the likelihood of a drop in heat transport efficiency. Furthermore, since a large number of holes must be bored in the metal block, there is a problem with increase in manufacturing cost.

SUMMARY OF THE INVENTION

It is an object of the present invention to solve the abovementioned problems by providing a thermosiphon of low cost and simple construction and having a condenser which can reliably discharge a condensed working fluid from an outlet pipe even if the apparatus is somewhat inclined.

A thermosiphon according to a first aspect of the present invention is one where in a thermosiphon comprising a condenser connected to a cold part of a refrigeration apparatus, and an inlet pipe and outlet pipe connected to the condenser and which can pass a working fluid thereinside, the condenser comprises; an attachment part attached to the cold part for conducting heat from the cold part, and a condensing part provided at an end of the attachment part for condensing the working fluid, and the condensing part has a cavity portion thereinside, and an inside bottom part of the cavity portion is formed descending towards an outlet hole communicating with an outlet pipe for the working fluid.

By having the above construction for the present invention, when the working fluid in a vapor state which has flowed to the condensing part from the inlet pipe loses heat in the cavity portion inside the condensing part and is liquefied, it accumulates at the inside bottom part of the cavity portion and flows out from the outlet hole communicated with the outlet pipe. At this time, since the inside bottom part of the cavity portion is formed descending towards the outlet hole which is communicated with the outlet pipe of the working fluid, then even if the condenser is somewhat inclined, if this incline is less than the slope of the inside bottom part of the cavity portion which descends towards the outlet pipe, the working fluid does not accumulate in the condensing part, and flows along the inside bottom part of the cavity portion and flows out from the outlet hole to the outlet pipe. Hence there is no drop in heat transport efficiency.

Furthermore, a thermosiphon of a second aspect of the invention is one where in the first aspect of the invention, the condensing part is constructed with a heat exchange member attached to the cavity portion. By constructing the present invention in the above manner, the condensing part can be easily constructed by attaching a separately formed heat exchange member to inside the concavity portion.

A thermosiphon of a third aspect of the invention is one where in the second aspect of the invention, the heat exchange member is constructed from a plate-like base, and a heat exchange part provided upright on the base, the construction being such that the cavity portion is sealed by the base. By constructing the present invention in the above manner, the heat exchange part of the heat exchange member can be inserted into the cavity portion formed in the condensing part, and also the opening of the cavity portion can be sealed by the plate-like base of the heat exchange member. Therefore the sealing of the cavity portion and the attachment of the heat exchange member can be performed simultaneously. Hence assembly of the condensing part becomes even easier.

Furthermore, a thermosiphon of a fourth aspect of the invention is one where in any one of the first through third aspects of the invention, the inside bottom part of the cavity portion is formed descending so as to incline more than 10 degrees with respect to the horizontal direction when the condenser is connected to the cold part of the refrigeration apparatus. By constructing the present invention in the above manner, then with a refrigerator or the like incorporating the refrigeration apparatus and which is specified for example by law so that at least this will not fall over if inclined at 10 degrees, since the inside bottom part is inclined at more than 10 degrees to the horizontal direction, then even if it is inclined within the specified range, the working fluid will not accumulate in the condensing part, and will flow down along the inside bottom part of the cavity portion and flow out from the outlet hole to the outlet pipe.

DESCRIPTION OF THE PREFERRED EMBODIMENTS

Figure 1:
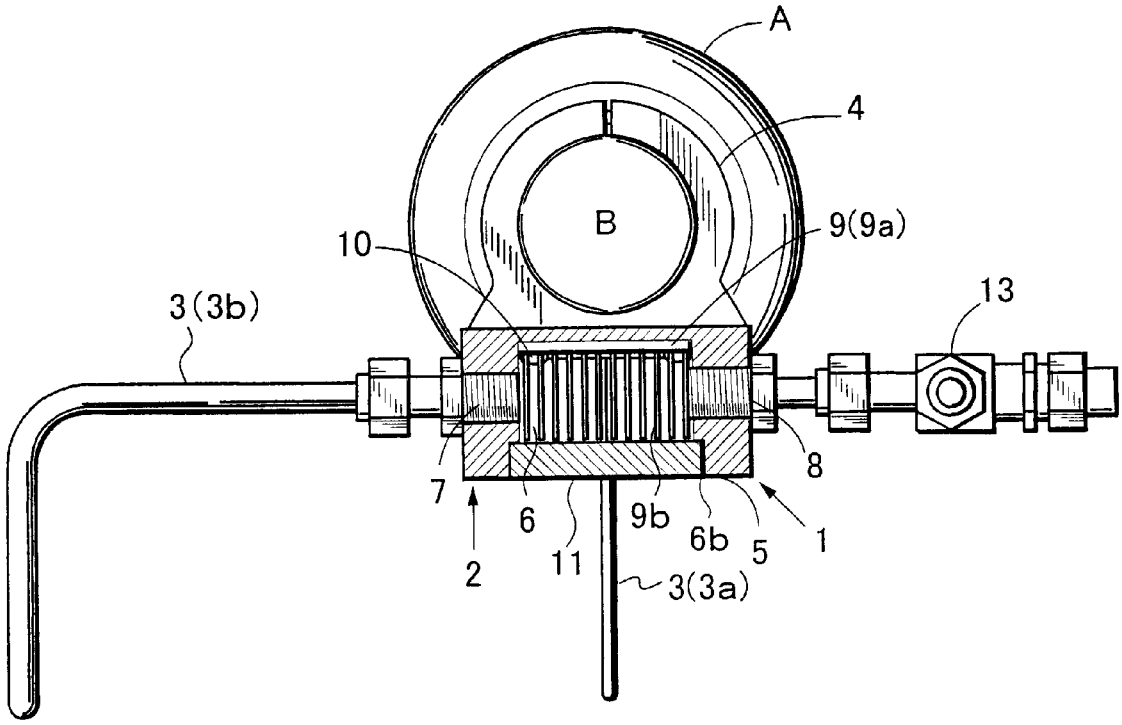
FIG. 1 is a transverse section view showing a thermosiphon according to a first embodiment of the present invention.
Figure 2:
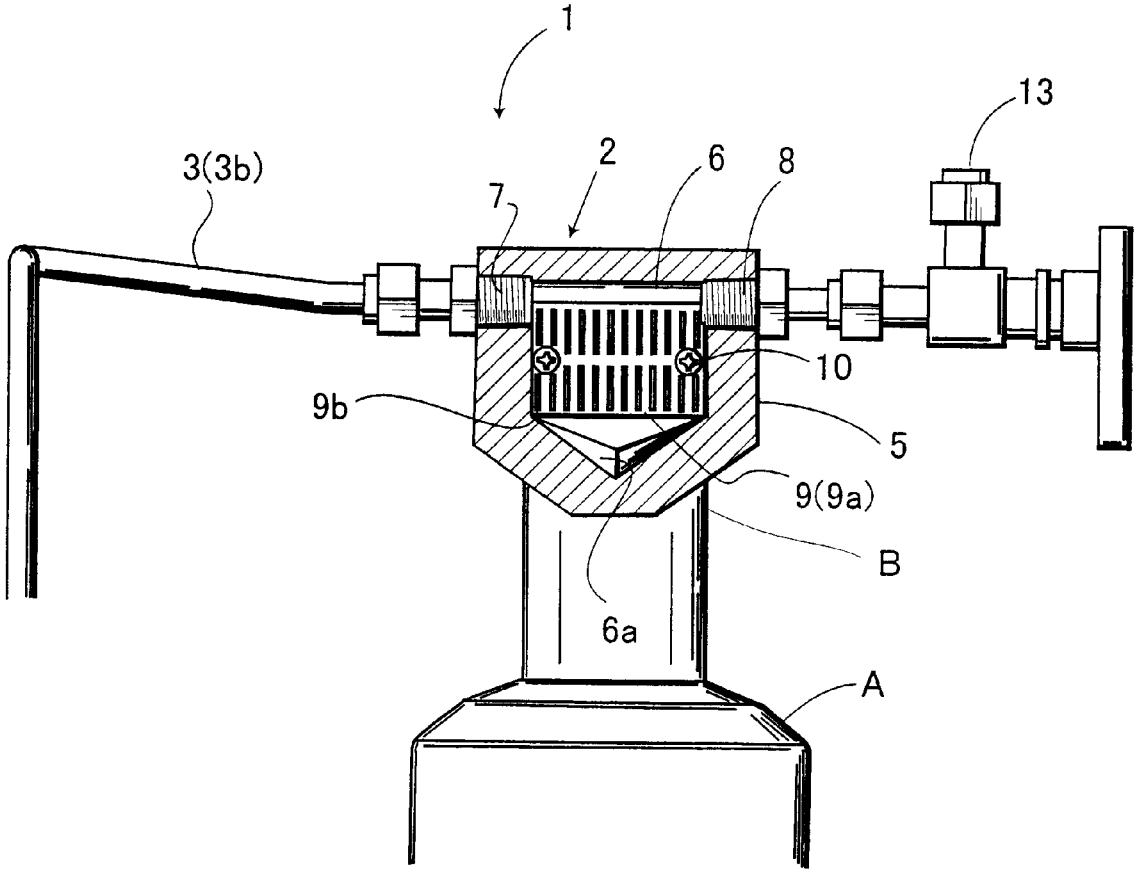
FIG. 2 is a vertical section view of the first embodiment.
Figure 3:
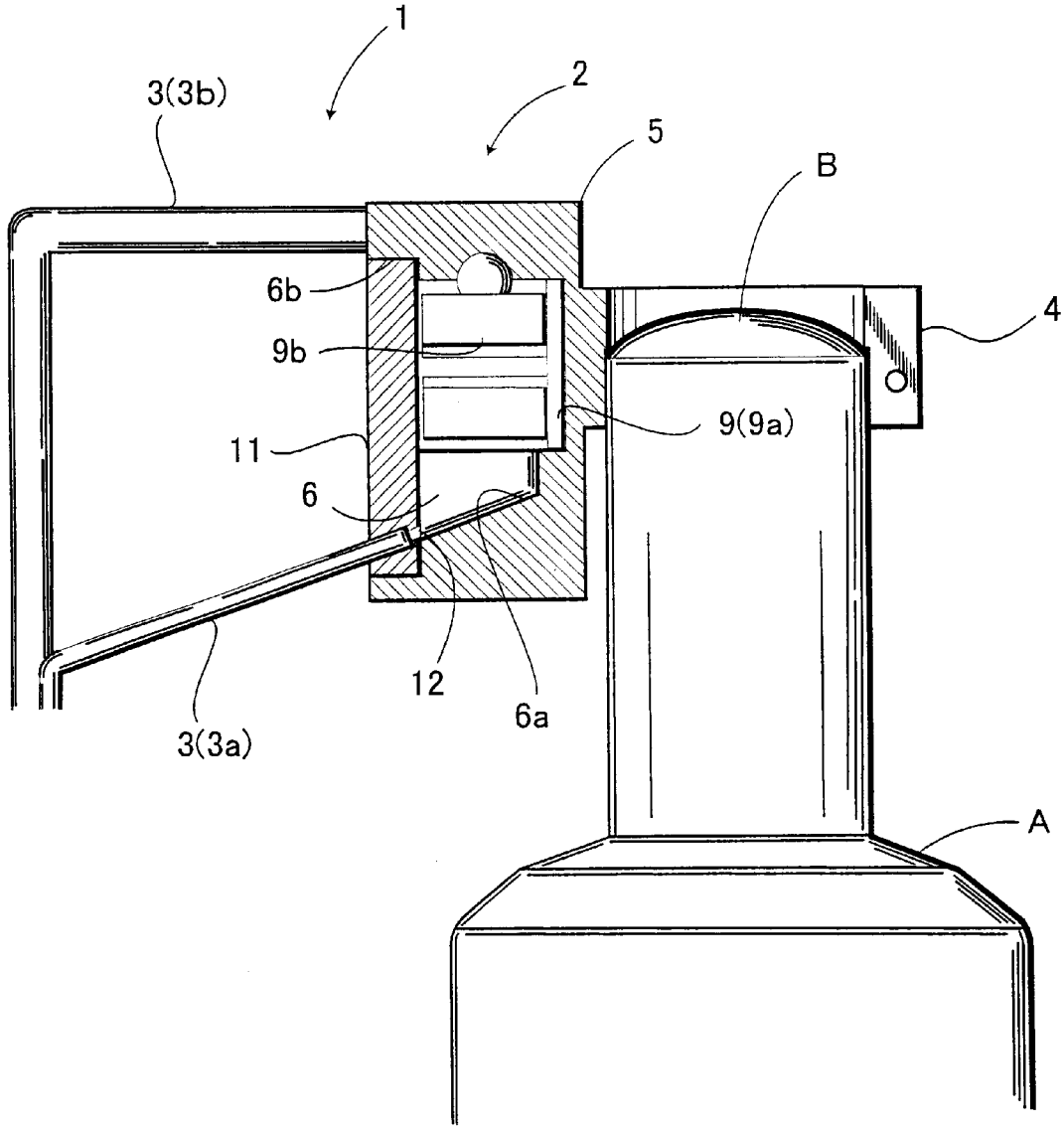
FIG. 3 is a vertical section view of the first embodiment seen from another direction.

Hereunder is a description of a first embodiment of the present invention based on, FIG. 1 through FIG. 3. In these figures, A denotes a refrigeration apparatus. A thermosiphon 1 of this embodiment is attached to a cold part B of the refrigeration apparatus A. This thermosiphon 1 comprises a condenser 2 and a copper pipe 3 connected to the condenser 2. The condenser 2 comprises a band shape brass attachment part 4 and a condensing part 5 provided integral with the attachment part 4. Furthermore, the attachment part 4 is attached to the outer periphery of the cold part B so as to be tightly clamped in close contact thereto. Moreover, the condensing part 5 is formed in a box shape, with an interior forming a cavity portion 6. Through holes 7 and 8 communicating with the cavity portion 6 are formed in the upper side portions of the cavity portion 6. Furthermore, an inside bottom part 6*a* of the cavity portion 6 is formed with an incline so as to become lower towards the center and the outlet side, in a condition as shown in FIG. 2 and FIG. 3 with the condenser 2 attached to the cold part B. The incline angle of the inside bottom part 6*a* is made an incline of 15 degrees or more even at a position where the incline is most gentle with respect to the horizontal direction. Moreover, an aluminum alloy heat sink 9, being a heat exchange member, is secured to the cavity portion 6. The heat sink 9 comprises a plate-like base 9*a* and a plurality of fins 9*b*, being heat exchange parts, provided upright on the base 9*a*. The base 9*a* is secured to the cavity portion 6 on the attachment part 4 side with screws 10, which are tightened. By inserting a copper foil or the like (not shown in the figure) between the base 9*a* of the heat sink 9 and the cavity portion 6 and then tightening the screws 10, the copper foil is deformed so that the base 9*a* of the heat sink 9 and fine irregularities of the cavity portion 6 are filled. Hence and improvement in the heat conduction efficiency can be expected.

The cavity portion 6 is sealed by brazing a brass lid 11 into an opening 6*b*. Moreover, an outlet hole 12 is formed in a lower center of the lid 11 at a central lowermost edge position on the opening side of the cavity portion 6, and a capillary 3*a* of the pipe 3, being the outlet pipe, is connected to the outlet hole 12. Since the inside bottom part 6*a* of the cavity portion 6 is formed in the above manner, inclined so as to become lower towards the central and opening side, the construction is such that the condensed working fluid flowing down to the inside bottom part 6*a* of the cavity portion 6 flows along the slope of the inside bottom part 6*a* and flows in to the capillary 3*a* from the outlet hole 12. Furthermore, a large pipe part 3*b* of the pipe 3, being an inlet pipe, is connected to the through hole 7 of the condensing part 5, the construction being such that the gasified working fluid is able to flow to inside the cavity portion 6 from the large pipe 3*b* via the through hole 7. Furthermore, the capillary 3*a* and the large pipe 3*b* are communicated via an article to be cooled (not shown in the figure).

A filling member 13 is connected to the through hole 8, the construction being such that the working fluid can be filled to inside the cavity portion 6 and the pipe 3 from the filling member 13 via the through hole 8. Then, after filling the working fluid to inside the cavity portion 6 and the pipe 3, the filling member 13 is sealed off.

The operation with this construction will now be described. When the refrigeration apparatus A is driven, heat is absorbed by the cold part B of the refrigeration apparatus A. Therefore, heat moves from the heat sink 9 and the condensing part 5 via the attachment part 4 to the cold part B, and as a result, the interior of the cavity portion 6 is cooled. Then, due to the interior of the cavity portion 6 being cooled, the working fluid existing inside the cavity portion 6 which is a vapor immediately after flowing in from the large pipe 3*b*, is condensed at the surface of the heat sink 9 (the fins 9*b*) and at the inside surface of the cavity portion 6, to become a liquid and then flows down to the inside bottom part 6*a*. At this time, since the inside bottom part 6*a* is inclined so as to descend towards the center of the cavity portion 6 and towards the outlet side, the condensed working fluid flows towards one point on the inside bottom part 6*a*. Then, since the outlet hole 12 is formed in the lower center of the lid 11 and corresponding to the center of the lowermost edge of the cavity portion 6 where the working fluid converges, the condensed working fluid reliably flows in to the capillary 3*a* of the pipe 3 from the outlet hole 12 without accumulating inside the cavity portion 6. In particular, in this embodiment, since even at the most gentle sloping position the incline angle of the inside bottom part 6*a* is more than 10 degrees, then even if the entire body of the condenser 2, that is the refrigeration apparatus A itself, is inclined at 10 degrees, the working fluid reliably moves without accumulating. Here, a unit such as a refrigerator incorporating the refrigeration apparatus A and the thermosiphon 1, is normally specified by electrical equipment safety laws, so that at least this will not fall over if inclined at 10 degrees. Therefore, if the inside bottom part 6*a* is such that even at the most gentle slope position the inclination angle is more than 10 degrees, then provided the apparatus is within the specified inclination, the condensed working fluid flows towards the outlet hole 12 in the inside bottom part 6*a*. Hence even if the apparatus such as the refrigerator incorporating the refrigeration apparatus A and the thermosiphon 1 is inclined, the aforementioned operation can be maintained.

The working fluid which has flowed into the capillary 3*a* of the pipe 3 in this manner after taking heat from an article to be cooled (not shown in the figure) of for example a cold room of a cold store and being gasified, returns to the cavity portion 6 from the large pipe 3*b* via the through hole 7, and again loses heat and is condensed. By repeating the above operation, the article to be cooled (not shown in the figure) is cooled.

The thermosiphon 1 of the present embodiment as described in detail above comprises; the condenser 2 connected to the cold part B of the refrigeration apparatus A, and the capillary 3*a* and large pipe 3*b* connected to the condenser 2 and through which the working fluid can flow thereinside. The condenser 2 comprises the attachment part 4 attached to the cold part B for conducting heat of the cold part B, and the condensing part 5 provided at the end portion of the attachment part 4 for condensing the working fluid. The condensing part 5 has the cavity portion 6 thereinside, and the inside bottom part 6*a* of the cavity portion 6 is formed so as to decline towards the outlet hole 12 communicated with the capillary 3*a*. Hence when the vapor state working fluid flowing in from the large pipe 3*b* to the capillary 3*a* loses heat at the cavity portion 6 inside the condensing part 5 and is liquefied, this accumulates in the inside bottom part 6*a* of the cavity portion 6 and flows out from the outlet hole 12 which is communicated with the capillary 3*a*. At this time, since the inside bottom part 6*a* of the cavity portion 6 is formed so as to decline towards the outlet hole 12 which is communicated with the capillary 3*a*, then even if the condenser 2 is somewhat inclined, if this incline is less than the incline of the inside bottom part 6*a* of the cavity portion 6 declining towards the outlet hole 12, a downward incline with respect to the horizontal direction is maintained. Hence the working fluid does not accumulate in the condensing part 5. The working fluid flows along the inside bottom part 6*a* of the cavity portion 6 and flows out from the outlet hole 12 to the capillary 3*a*, thus giving an improvement in heat transport efficiency. In particular, in the present embodiment, the inside bottom part 6*a* of the cavity portion 6 is formed with a decline so that this is inclined more than 10 degrees with respect to the horizontal direction when the condenser 2 is connected to the cold part B of the refrigeration apparatus A. Therefore since the apparatus incorporating the refrigeration apparatus A such as a refrigerator is specified by law so that so that at least this will not fall over if inclined at 10 degrees, then even if this is inclined within the specified range, the working fluid will not accumulate in the condensing part 5, and will flow down along the inside bottom part 6*a* of the cavity portion 6 and flow out from the outlet hole 12 to the capillary 3*a*. Furthermore, the condensing part 5 is constructed such that the heat sink 9 is attached to the cavity portion 6. By attaching the separately formed heat sink 9 to inside the cavity portion 6, the condensing part 5 can be easily formed, and hence the thermosiphon 1 can be easily manufactured.

Figure 4:
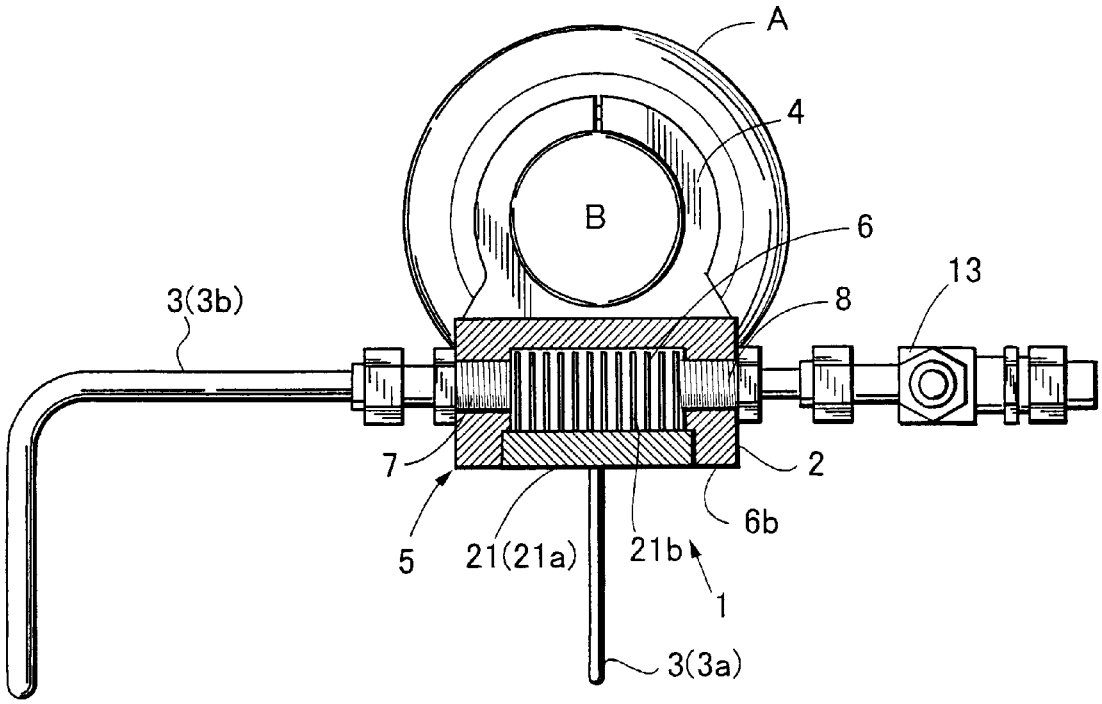
FIG. 4 is a transverse section view showing a thermosiphon according to a second embodiment of the present invention.
Figure 5:
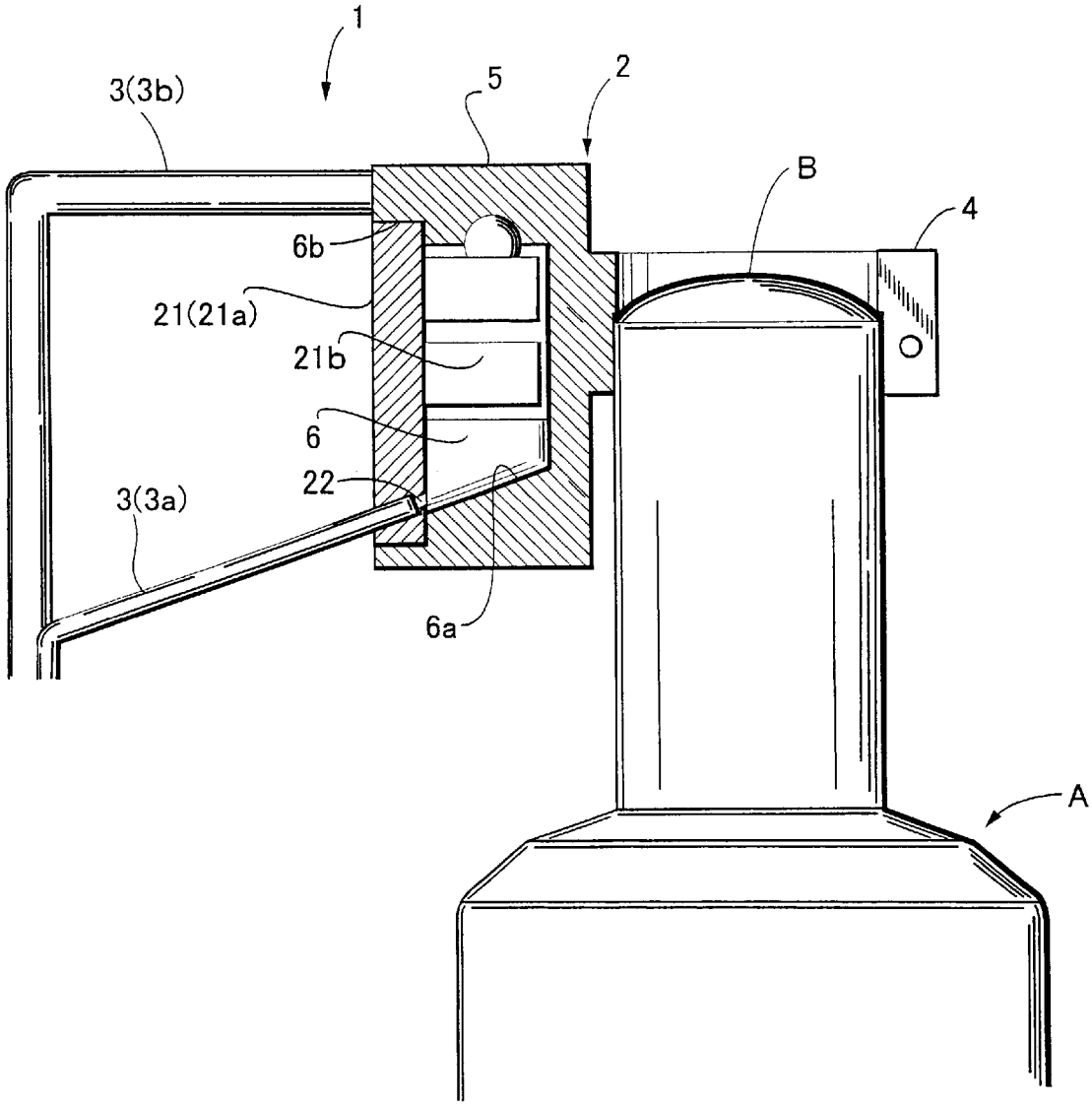
FIG. 5 is a vertical section view of the second embodiment.

Next is a description of a second embodiment of the present invention with reference to FIG. 4 and FIG. 5. The thermosiphon of the second embodiment has basically the same construction as that of the first embodiment, and hence parts common to the first embodiment are denoted by common reference symbols and detailed description thereof is omitted. In this embodiment, an aluminum alloy heat sink 21, being a heat exchange member, is secured to the opening 6*b* of the cavity portion 6 of the condenser 2. The heat sink 21 comprises a plate-like base 21*a* and a plurality of fins 21*b*, being heat exchange parts, provided upright on the base 21*a*. By securing the outer periphery of the base 21*a* to the opening 6*b* of the cavity portion 6, a closed lid results. Furthermore, in this condition, the fins 21*b* of the heat sink 21 are positioned in the inner portion of the cavity portion 6. Moreover, an outlet hole 22 is formed in a lower center of the base 21*a* of the heat sink 21. The capillary 3*a* of the pipe 3, being the outlet pipe, is connected to the outlet hole 22, and as with the above described first embodiment, the construction is such that the condensed working fluid flowing down to the inside bottom part 6*a* of the cavity portion 6 flows along the inside bottom part 6*a* and flows in to the capillary 3*a* from the outlet hole 22.

The operation for the above construction will now be described. The operation itself of the present embodiment is basically the same as for the above described first embodiment. Accordingly, comparing the first embodiment and the present embodiment, in the first embodiment, the heat sink 9 which can be thought to have the greatest endothermic amount, is attached to the attachment part 4 side of the cavity portion 6. Therefore the heat absorbed by the heat sink 9 smoothly reaches to the cold part B via the attachment part 4. On the other hand, with the present embodiment, the heat absorbed by the heat sink 21 reaches to the cold part B from the attachment part 4 via the opening 6*b* and the condensing part 5. Therefore the absorption efficiency itself is not as good as for the first embodiment. However, in the first embodiment the interior of the cavity portion 6 must be closed off by the lid 11 after attaching the heat sink 9 thereto, whereas with the present embodiment, the base 21*a* of the heat sink 21 is also used as a lid. Hence attachment of the lid and attachment of the heat sink 21 can be simultaneously carried out in one step. Therefore assembly of the thermosiphon 1 is facilitated, enabling low cost manufacture.

Regarding the thermosiphon 1 of the present embodiment as detailedly described above, the heat sink 21 comprises the plate-like base 21*a* and the fins 21*b* provided upright on the base 21*a*, the construction being such that the cavity portion 6 is sealed by the base 21*a*. Hence the fins 21*b* of the heat sink 21 can be inserted into the cavity portion 6 formed in the condensing part 5, and also the opening 6*b* of the cavity portion 6 can be sealed by the plate-like base 21*a* of the heat sink 21. Therefore the sealing of the cavity portion 6 and the attachment of the heat sink 21 can be performed simultaneously. Hence assembly of the condensing part 5 becomes even easier.

Figure 6:
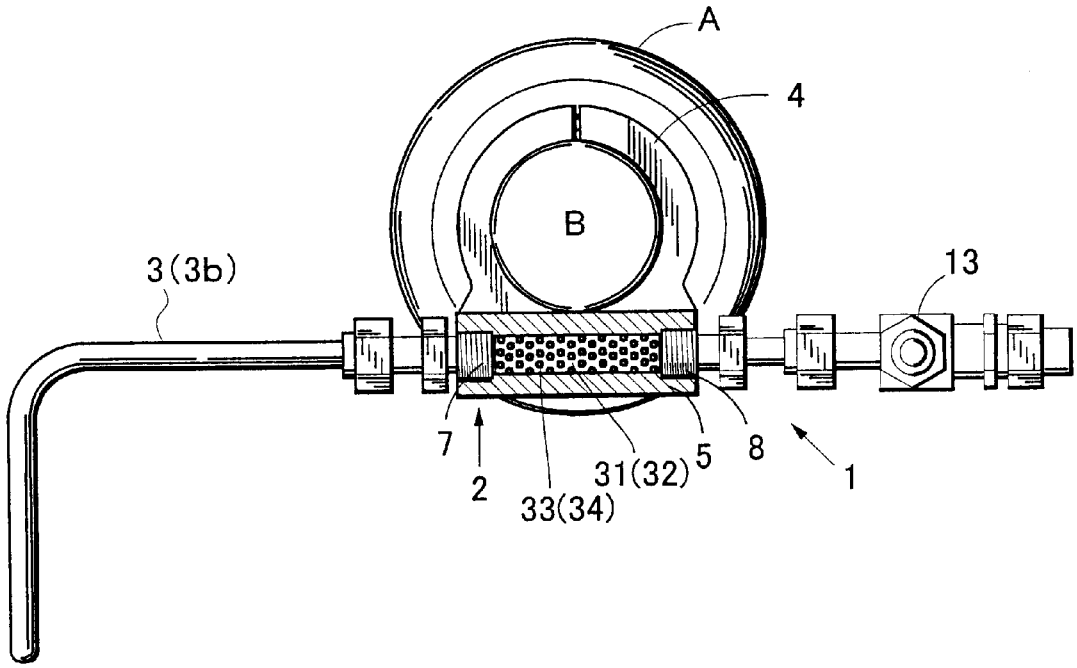
FIG. 6 is a transverse section view showing a thermosiphon according to a third embodiment of the present invention.
Figure 7:
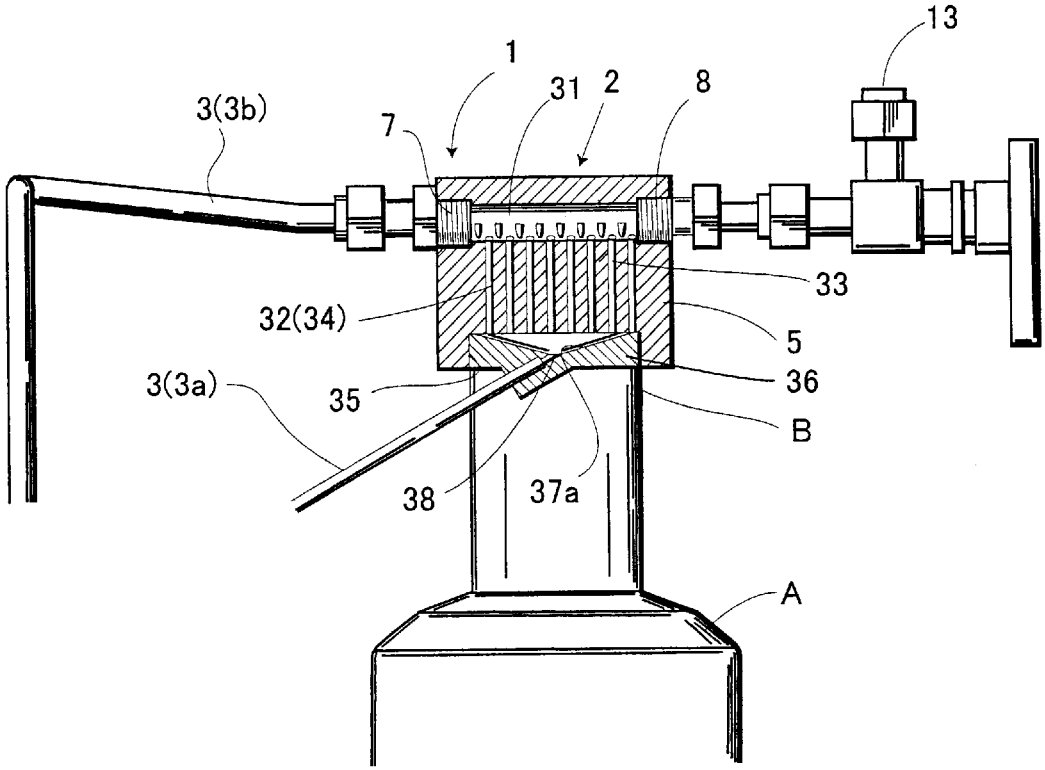
FIG. 7 is a vertical section view of the third embodiment.
Figure 8:
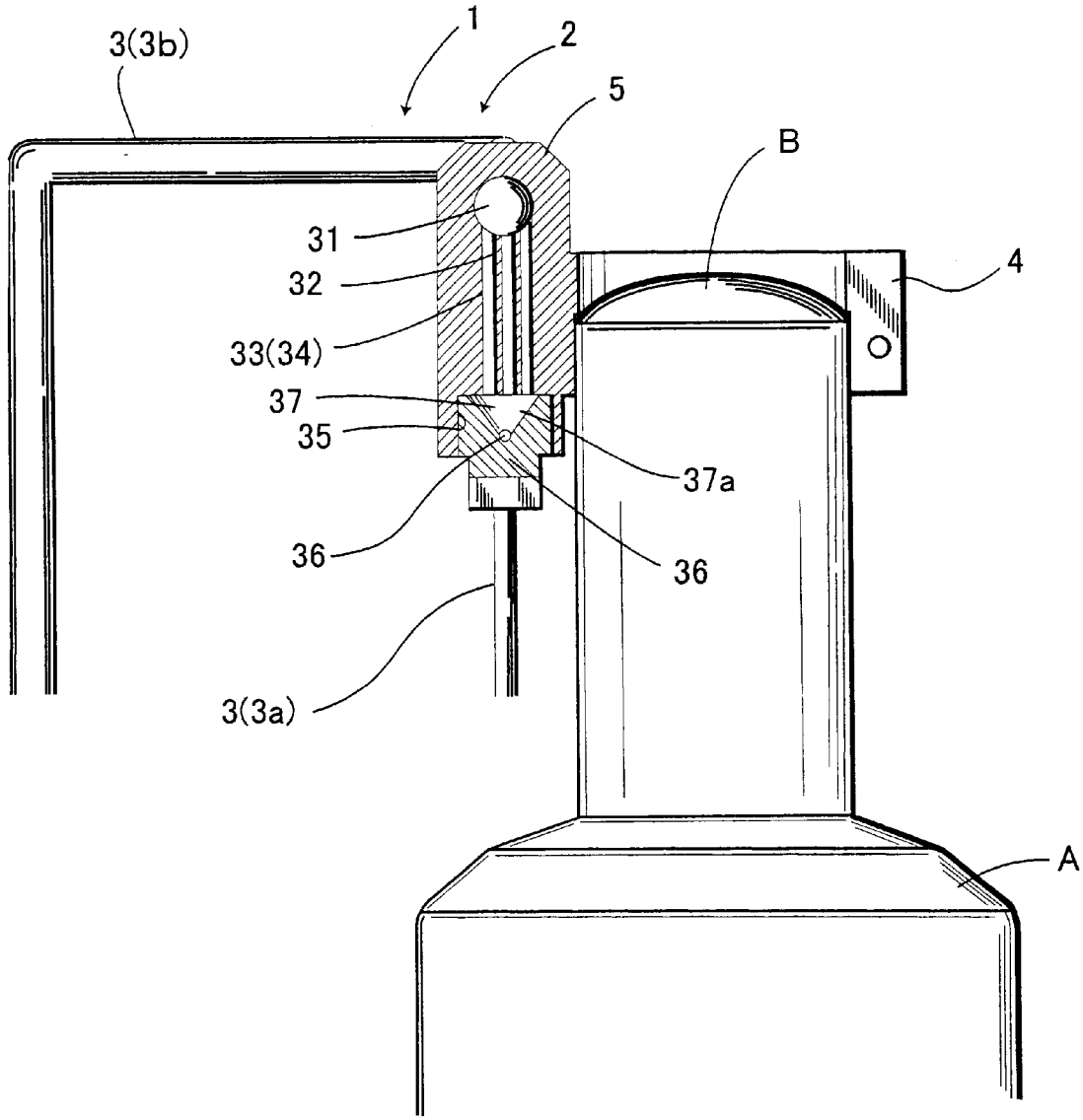
FIG. 8 is a vertical section view of the third embodiment seen from another direction.

Moreover, a third embodiment of the present invention will now be described with reference to FIG. 6 through FIG. 8. The thermosiphon of the third embodiment has basically the same construction as that of the abovementioned first embodiment, and hence parts common to the first embodiment are denoted by common reference symbols and detailed description there is omitted. In the thermosiphon 1 of the third embodiment, the condensing part 5 is formed in a box shape which is thinner than for the aforementioned first and second embodiments, and a first cavity portion 31 of cylindrical shape is formed thereinside. On a lower side of the first cavity portion 31, a heat exchange part 34 is formed by forming a plurality of through holes 33, being cold parts, vertically in a base 32. The lower side of the heat exchange part 34 constitutes an open concavity 35. This open concavity 35 is sealed by soldering a brass lid 36 thereto. Furthermore, a second cavity portion 37 is formed at the lower side of the heat exchange part 34 by the lid 36. The first cavity portion 31 and the second cavity portion 37 are communicated by the through holes 33. Moreover, an inside bottom part 37*a* of the second cavity portion 37, in a condition as shown in FIG. 7 with the condenser 2 attached to the cold part B, is formed at an incline so as to become lower towards the center of the condenser 2, and at the central lowermost edge is formed an outlet hole 38 which is inclined downwards towards the through hole 7 side, and a capillary 3*a* of the pipe 3, being the outlet pipe, is connected to the outlet hole 38.

The operation of the present embodiment is basically the same as for the above mentioned first embodiment in that the through holes 33 formed in the beat exchange part 34 demonstrates the same function as the fins 9*b* in the abovementioned first embodiment. In this manner, the heat exchange part 34 may be constructed by the plurality of through holes 33, and is not limited to the heat sink 9 provided with the fins 9*b*. Furthermore, provided that the inside bottom part 37*a* through which the working fluid flows is formed so as to descend towards the outlet hole 38, there is no particular limit to the inclination direction.

The abovementioned respective embodiments of the present invention have been described with reference to the appended drawings, however the present invention is not limited to the abovementioned respective embodiments, and various modifications are possible within a scope of the gist of the present invention. For example, in the abovementioned respective embodiments, the construction is such that the inside bottom part of the cavity portion falls towards the center of the opening. However the construction may be such that this falls towards a position other than this, such as an edge portion on either the left or right of the opening portion. Furthermore, the inside bottom part of the cavity portion is formed in a curved surface shape slope, however this may be formed in a flat surface shape. Moreover, in the abovementioned respective embodiments, the outlet hole is formed in the lid, however this may be provided in the lower side of the condensing part. Furthermore, the invention has been described using the heat sink with fins provided upright on the base, as the heat exchange member. However, a heat exchange member other than this may be used.

The thermosiphon according to the first aspect of the present invention is one where in a thermosiphon comprising a condenser connected to a cold part of a refrigeration apparatus, and an inlet pipe and outlet pipe connected to the condenser and which can pass a working fluid thereinside, the condenser comprises; an attachment part attached to the cold part for conducting heat from the cold part, and a condensing part provided at an end of the attachment part for condensing the working fluid, and the condensing part has a cavity portion thereinside, and an inside bottom part of the cavity portion is formed descending towards an outlet hole communicating with an outlet pipe for working fluid. The working fluid in a vapor state which has flowed to the condensing part from the pipe loses heat in the cavity portion inside the condensing part and is liquefied, and accumulates at the inside bottom part of the cavity portion and flows out from the outlet hole communicated with the outlet pipe. At this time, even if the condenser is somewhat inclined, if this incline is less than the slope of the inside bottom part of the cavity portion which descends towards the outlet pipe, the working fluid does not accumulate in the condensing part, and flows along the inside bottom part of the cavity portion and flows out from the outlet hole to the pipe. Therefore, irrespective of the attitude under use conditions, the working fluid is well circulated inside the pipe so that this can operate reliably.

Furthermore, the thermosiphon of the second aspect of the invention is one where in the first aspect of the invention, the condensing part is constructed with a heat exchange member attached to the cavity portion. Since the condensing part can be easily constructed by attaching a separately formed heat exchange member to inside the concavity portion, it gives a thermosiphon where the condenser part is simpler, enabling a lower cost construction.

The thermosiphon of the third aspect of the invention is one where in the second aspect of the invention, the heat exchange member is constructed from a plate-like base, and a heat exchange part provided upright on the base, the construction being such that the cavity portion is sealed by the base. By inserting the heat exchange part of the heat exchange member into the cavity portion formed in the condensing part, and also sealing the opening of the cavity portion by the plate-like base of the heat exchange member, this gives a thermosiphon where the condenser can be easily constructed with a minimum number of parts.

Furthermore, the thermosiphon of the fourth aspect of the invention is one where in any one of the first through third aspects of the invention, the inside bottom part of the cavity portion is formed descending so as to incline more than 10 degrees with respect to the horizontal direction when the condenser is connected to the cold part of the refrigeration apparatus. With a refrigerator or the like incorporating a refrigeration apparatus, which is specified by law so that at least this will not fall over if inclined at 10 degrees, this gives a thermosiphon where even if this is inclined within the range of 10 degrees corresponding to the law, the working fluid will not accumulate in the condensing part, and can flow down along the inside bottom part of the cavity portion and flow out from the outlet hole to the outlet pipe.

What is claimed is:

1. A thermosiphon comprising a condenser connected to a cold part of a refrigeration apparatus, and an inlet pipe and outlet pipe connected to said condenser and which can pass a working fluid thereinside, said condenser comprising;

an attachment part attached to said cold part for conducting cold from said cold part, and a condensing part provided at an end of said attachment part for condensing said working fluid, wherein said condensing part has a cavity portion thereinside, and an inside bottom part of said cavity portion is formed descending towards an outlet hole communicating with an outlet pipe for working fluid.

2. A thermosiphon according to claim 1, wherein said condensing part is constructed with a heat exchange member attached to said cavity portion.

3. A thermosiphon according to claim 2, wherein said heat exchange member is constructed from a plate-like base, and a heat exchange part provided upright on said base, the construction being such that said cavity portion is sealed by said base.

4. A thermosiphon according to claim 1, wherein the inside bottom part of said cavity portion is formed descending so as to incline more than 10 degrees with respect to the horizontal direction when said condenser is connected to the cold part of the refrigeration apparatus.

5. A thermosiphon according to claim 2, wherein the inside bottom part of said cavity portion is formed descending so as to incline more than 10 degrees with respect to the horizontal direction when said condenser is connected to the cold part of the refrigeration apparatus.

6. A thermosiphon according to claim 3, wherein the inside bottom part of said cavity portion is formed descending so as to incline more than 10 degrees with respect to the horizontal direction when said condenser is connected to the cold part of the refrigeration apparatus.

* * * * *

UNITED STATES PATENT AND TRADEMARK OFFICE

CERTIFICATE OF CORRECTION

PATENT NO. : 6,539,733 B2
DATED : April 1, 2003
INVENTOR(S) : K. Sone

It is certified that error appears in the above-identified patent and that said Letters Patent is hereby corrected as shown below:

Title page,
Item [56], References Cited, FOREIGN PATENT DOCUMENTS, the following should be included:
-- 2000-337734 12/08/00 Japan --

OTHER PUBLICATIONS, the following should be included:
-- English Language Abstract of JP 2000-337734 --

Signed and Sealed this

Sixth Day of January, 2004

JAMES E. ROGAN
*Director of the United States Patent and Trademark Office*